United States Patent [19]

Culver

[11] 3,996,473

[45] Dec. 7, 1976

[54] PULSED NEUTRON GENERATOR USING SHUNT BETWEEN ANODE AND CATHODE

[75] Inventor: Richard B. Culver, Houston, Tex.

[73] Assignee: Dresser Industries, Inc., Dallas, Tex.

[22] Filed: Aug. 15, 1975

[21] Appl. No.: 605,097

Related U.S. Application Data

[63] Continuation-in-part of Ser. No. 468,111, May 8, 1974, abandoned.

[52] U.S. Cl. ..... 250/501

[51] Int. Cl.[2] ..... G21G 4/02

[58] Field of Search ..... 250/501, 502

[56] References Cited

UNITED STATES PATENTS

| | | | |
|---|---|---|---|
| 2,960,610 | 11/1960 | Gale | 250/501 |
| 3,151,243 | 9/1964 | Mott | 250/501 |
| 3,309,522 | 3/1967 | Youmans et al. | 250/501 |

*Primary Examiner*—Harold A. Dixon
*Attorney, Agent, or Firm*—William E. Johnson, Jr.

[57] ABSTRACT

A pulsed neutron generator for well logging is provided having a resistor connected between the anode and cathode. The resistor provides a direct current path whereby corona current can flow between the cathode and a corona point without the necessity for the ion source to conduct. In an alternative embodiment, the secondary coil of a pulsing transformer is connected in series with a resistor between the anode and cathode. In an alternative embodiment, a corona regulator in series with the collector-emitter of a transistor is connected between the cathode and anode of the neutron source and the base drive to the transistor is provided by a light-responsive solar cell activatable by an external lamp. Circuitry is provided for utilizing the various neutron sources.

14 Claims, 8 Drawing Figures

PULSED NEUTRON GENERATOR USING SHUNT BETWEEN ANODE AND CATHODE

RELATED APPLICATION

This application is a continuation, at least in part, of may U.S. patent application Ser. No. 468,111, filed May 8, 1974, now abandoned for "Pulsed Neutron Generator Using Shunt Between Anode and Cathode."

BACKGROUND OF THE INVENTION

This invention relates to apparatus for causing ion beam accelerator tubes to generate neutrons and is particularly directed to apparatus of such character which are capable of being used in the logging of boreholes in the earth.

Pulsed neutron generators are known in the art, for example, those shown in U.S. Pat. No. 3,309,522 to Arthur H. Youmans, et al., and those illustrated in my U.S. Pat. No. 3,787,686. It is also known that such prior art pulsed neutron generators will emit neutrons at a steady state rate if the high voltage pulser is disabled. It is also known that such sources may exhibit pre-ignition if the pulsing frequency is much lower than 1000 cycles per second. Although this characteristic is of little or no consequence while pulsing the generator at that rate or higher, it has been put to use in the "subtraction method" of detecting gamma rays produced by inelastic scattering of fast neutrons as described in my aforementioned U.S. Pat. No. 3,787,686.

This tendency to pre-ignite or to go into a steady state conduction presents a disadvantage whenever it is desired to make logging runs which provide short half-life activation measurements, i.e., those measurements which might occur several milliseconds after the termination of the short burst of fast neutrons from the source.

It is therefore the primary object of the present invention to provide a new and improved pulsed neutron source which does not emit neutrons until an external source of excitation is applied;

It is also an object of the invention to provide a new and improved pulsed neutron source which can be extinguished upon the application of an external source of excitation; and It is yet another object of the invention to provide a well logging system utilizing the pulsed neutron sources built in accordance with the present invention.

The objects of the invention are accomplished, generally, by the provision of a pulsed neutron source wherein a direct current path is formed between the anode and cathode of an ion beam accelerator.

These and other objects, features and advantages of the present invention will be more readily appreciated from the following detailed specification and drawing, in which.

Figure 1:
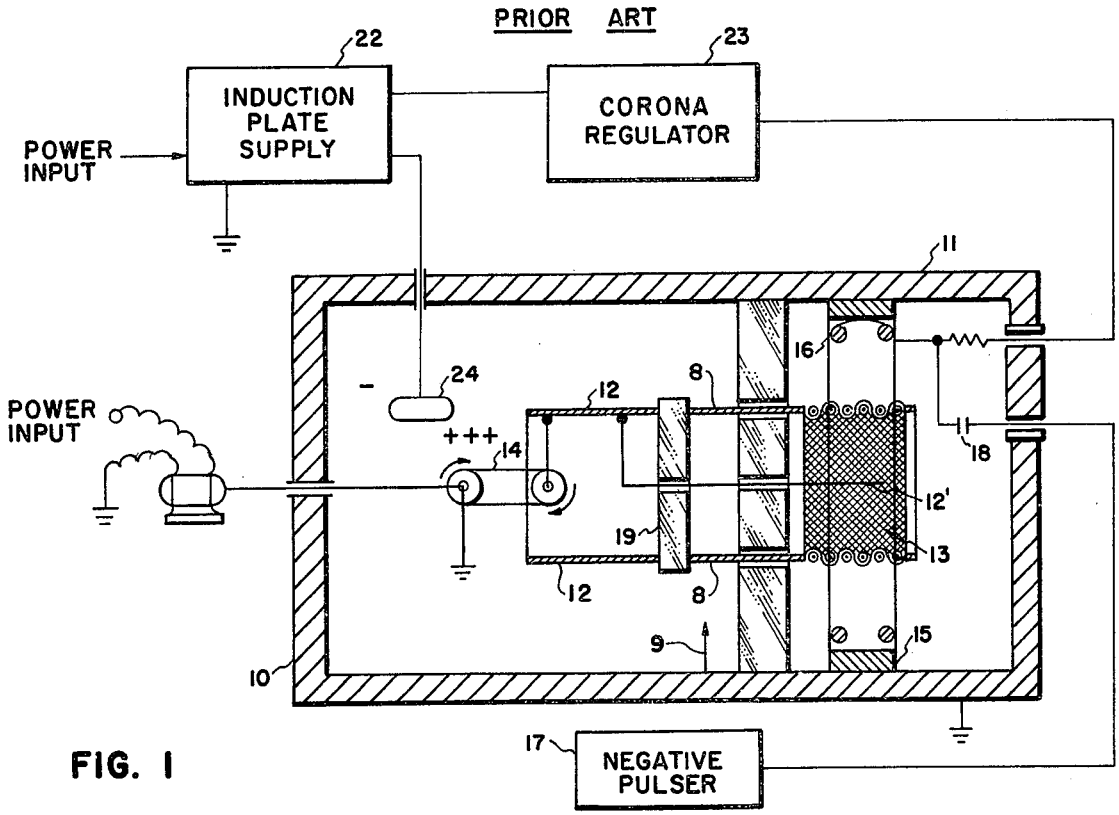
FIGS. 1 and 2 are schematic diagrams of pulsed neutron sources in the prior art.

Referring now to the drawing in more detail, especially to FIG. 1, there is illustrated a pulsed neutron source which is built in accordance with the prior art. For example, such a neutron source is fully described in the U.S. Pat. No. 3,309,522 which issued on Mar. 14, 1967, to Arthur H. Youmans, et at., and which is assigned to the assignee of the present invention. In brief, the neutron source 10 of FIG. 1 includes an accelerator tube 11 having an upper annular electrode 8 and a lower annular electrode 12 and an annular cathode 13 attached to the electrode 8 wherein the tube 11 contains an atmosphere of either deuterium of tritium (or a mixture of both). The annular anode 12 and annular anode 8 are in an end-abutting relationship, having the same longitudinal axis, but are separated by an insulator 19, constructed, for example, of glass or ceramic to provide an extremely high resistance between the anode and cathode, for example, several thousand or even several million megohms. A center wire anode 12' is connected to the annular anode 12 and is coaxial with cathode 13. The source 10 also includes a belt-driven electrostatic generator 14, such as the well-known Van de Graaf high voltage generator. An induction plate supply 22 is connected to an induction plate 24 located adjacent the lower pulley of the generator 14. The induction plate supply 22 is also connected through a suitable corona regulator 23 to apply a negative charge on the suppressor rings 16. A belt-shaped target 15, generally formed of a thin strip of titanium, and impregnated with either deuterium or tritium, or a mixture of both, is formed on the inside of the neutron source 10 in a manner to encircle the cathode 13 and anode 12'. Between the grounded target 15 and the cathode 13 are found one or more electrodes, generally referred to as the suppressor rings 16.

As is well known in the art, corona discharge is a non-uniform electric field phenomena where ionization may be maintained in the area of highest electrical stress between two electrodes. The voltage at which this local ionization occurs depends upon the shape and separation of the electrodes and the type and pressure of the contained gas. This ionization can occur at potentials as low as several hundred volts and is quite prevalent at potentials above several thousand volts. For a reference, see *High Voltage Technology*, edited by L. L. Alston, Oxford University Press, 1968. According to *Webster's New International Dictionary, Second Edition, Unabridged*, "Corona", as an electrical term, relates to "the discharge of electricity which appears on the surface of a conductor when the potential gradient exceeds a certain value." In common usage, corona current generally refers to any flash-over or parasitic discharge of current between two points resulting from the voltage potential between such points exceeding a given value.

The characteristics of corona discharge lend it to adaptation to low current voltage regulators and commercial voltage regulators based upon this principle are available from, for example, the Victoreen Instrument Company, Cleveland, Ohio.

The corona point 9 in FIG. 1 of the drawing is for the purpose of stabilizing by corona discharge the voltage generated by the Van de Graaf and which appears across the ion source electrode 13 and target 15.

The voltage which appears between anode 12' and cathode 13 of the ion source when it conducts is in the range of 350 to 1000 volts, depending upon physical dimensions of the structure, magnetic field strength (magnets not shown) and gas pressure.

The voltage between cathode 13 and target 15 is generally in the range of 80 to 120 kilovolts adjustable by the power input to the Van de Graaf and the length of the corona point 9. Typically, this voltage is 100 kilovolts.

Figure 2:
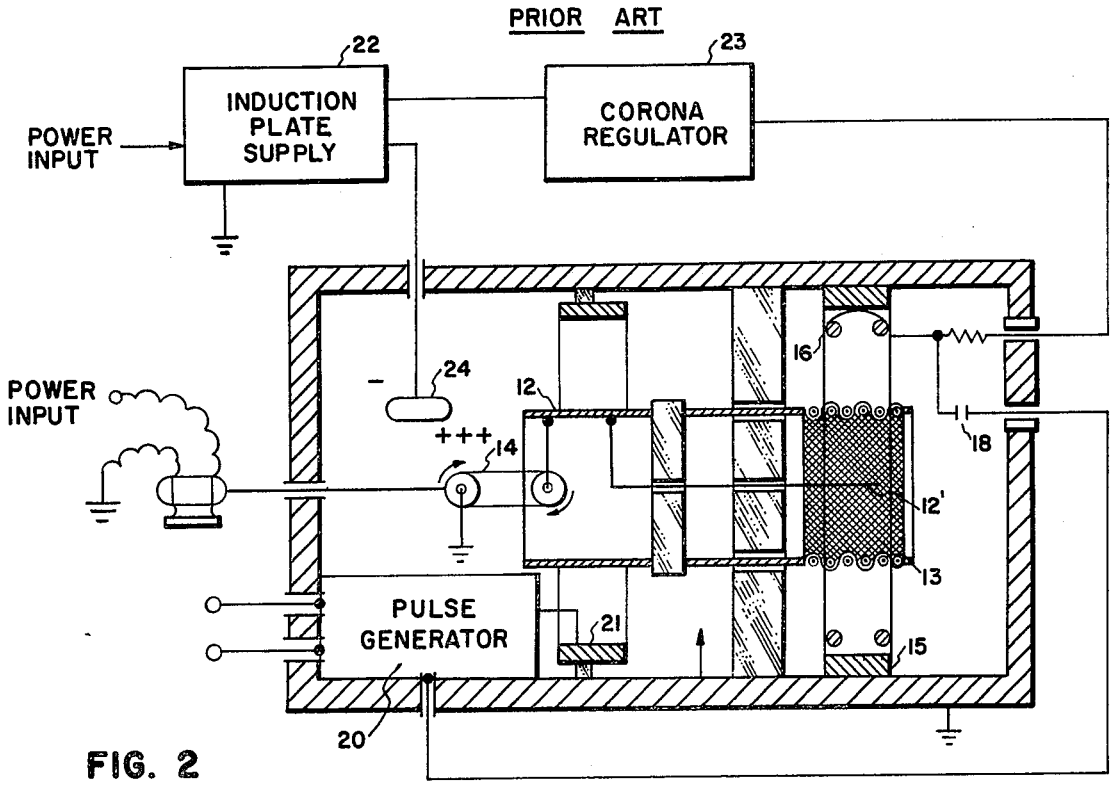

The corona regulator 23 shown in FIGS. 1 and 2 is a commercially available voltage regulator tube. The voltage at which it regulates, and therefore the voltage applied to the suppressor rings 16, is not particularly critical and is typically 2200 volts.

A pulse generator 17 is connected to the suppressor rings 16 by way of coupling capacitor 18, the capacitor 18 preferably being large in capacitance relative to the interelectrode capacitance between the suppressor rings 16 and the cathode 13. The pulse generator 17 is adapted to supply a sequence of negative pulses through the capacitor 18 to the suppressor rings 16 at a fixed preselected frequency, or at a rate determined by control apparatus generally located at the surface. Since the operation of the neutron source in accordance with FIG. 1 is fully described in the aforementioned U.S. Pat. No. 3,309,522 and also in my U.S. Pat. No. 3,787,686 which issued on Jan. 22, 1974, and which is also assigned to the assignee of the present invention, further description of this prior art neutron source need not be given here. However, with such prior art neutron sources, it should be appreciated that the anode 12' is caused to have a higher voltage potential then the cathode 13 to thus create an ionization potential between the two electrodes. As the magnitude of the positive charge on the anode 12' increases with respect to the cathode 13 and the grounded target 15, electrons begin to flow from the cathode 13 to the anode 12'. The voltage potential between cathode 13 and anode 12' at which ionization current begins to flow depends upon several factors, but is in the range of a few hundred to a few thousand volts. This electron flow across the ionization gap serves to ionize the deuterium or tritium in this region and thus the positively charged ions are correspondingly attracted toward the cathode 13. This electron flow and ionization also establishes the corona discharge current between the corona point 9 and the cathode 13. However, since the cathode 13 is formed in the manner of a mesh, most of the ions pass through the cathode 13 and are accelerated at very high speeds into the target 15. As is known in the prior art, it is this acceleration of the hydrogen isotope ions into the isotope nuclei in the target 15 which produces the neutrons.

In addition to the so-called "beam current" (ion flow) across the accelerating gap between the cathode and the target, the electrostatic generator is preferably adapted to develop a corona current flow between the electrode 8 and the generator tank shell. Since the electrode 8 is not only electrically isolated from the anode 12', but also from "ground", the potential on the electrode 8 rises with respect to "ground", as the ionization current between the anode and cathode ionizes the atmosphere, until a current flow develops somewhere between the electrode 8 and the shell of the tank. Thus, in order to stabilize the beam current, a corona point 9 (which is a sharp pointed electrode) is preferably fixed to the inside surface of the tank opposite the upper hollow electrode 8. Since the space between the tip of the corona point 9 and the nearest surface of the electrode 8 is narrower than the space between the electrode 8 (and cathode 13) and any other grounded part of the electrostatic generator, all leakage flow between the electrode 8 and ground (except for the beam current) will be concentrated between the corona point 9 and the nearest surface of the electrode 8. As is well known, it is an inherent characteristic of a corona discharge that the magnitude of the current flow is negligible until the voltage is brought to a certain magnitude $V_c$. However, as the voltage rises above $V_c$, the current flow becomes increasingly large and therefore, if the voltage established in a system between the electrode 8 and the corona point 9 is substantially greater than $V_c$, relatively large fluctuations in corona current flow will produce only relatively small fluctuations in the voltage between the corona point 9 and the electrode 8. The corona voltage at this point in the system is always equal to the voltage across the accelerating gap between the target and the cathode since the corona point 9 and the target 15 are both substantially at ground potential and the voltage across the accelerating gap between the cathode and the target will become relatively stabilized by the corona discharge notwithstanding substantial fluctuations in other parameters of the system. The operation of such a corona point is fully set forth in the aforementioned U.S. Pat. No. 3,309,522.

One way of visualizing the operation is to consider the capacitances between the anode and cathode and between the cathode and ground (the corona point 9 in FIG. 1). Because of the capacitance between the anode and cathode ($C_1$) being smaller than the capacitance between the cathode and ground ($C_2$), the system can be considered as a capacitance divider between the anode and ground, with the greater voltage naturally being developed across the smaller capacitance $C_1$. The voltage across $C_1$ will eventually build up to the ionization point and fire the tube. This occurs without any external high voltage pulses being applied. After and during ionization, the corona current can then flow from the cathode to the corona point.

Referring now to FIG. 2, there is illustrated another prior art neutron source which is also described in the aforementioned U.S. Pat. No. 3,309,522, and also in my U.S. Pat. No. 3,787,686. With this particular neutron source, a pulse generator 20 is provided which supplies negative pulses through a coupling capacitor 18 to the suppressor ring 16 but which also supplies positive pulses to the annular electrode 21 to further aid in the pulsing of the neutron source.

As fully explained in the aforementioned U.S. Pat. No. 3,787,686, the neutron sources of FIGS. 1 and 2 have a common characteristic, i.e., if the pulse repetition rate is too low, the neutron source pre-ignites and goes into a continuous mode and is no longer operating as a pulsed neutron source. while this is acceptable in practicing the so-called "subtraction methodl" in accordance with my aforementioned patent, such a consequence is undesirable when it is desired to have a longer period of time between neutron pulses such as is desirable, for example, in activation logging.

Figure 3:
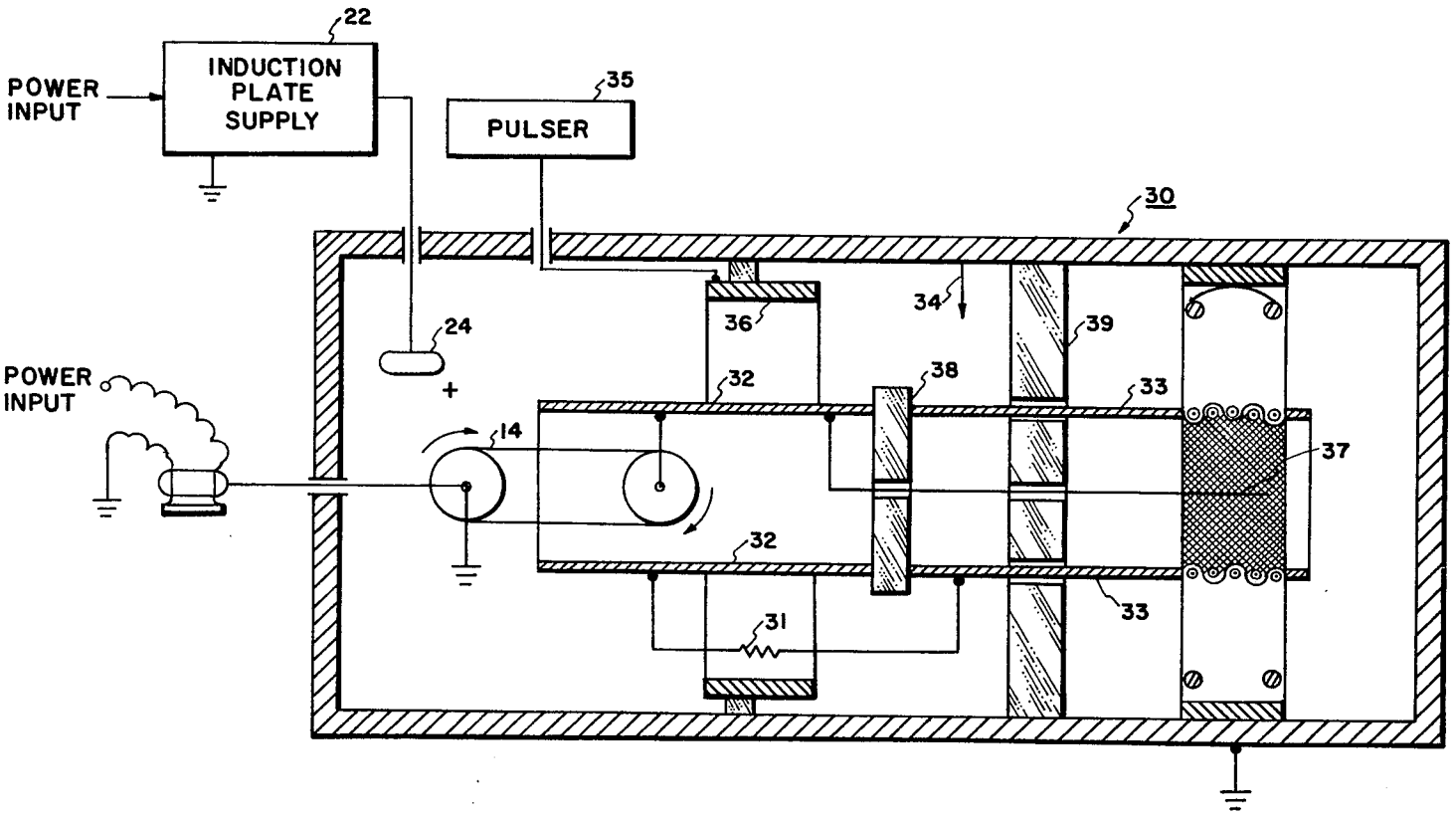
FIG. 3 is a schematic diagram of a pulsed neutron source in accordance with the present invention.

Referring now to FIG. 3, there is illustrated a pulsed neutron source 30 in accordance with the present invention which can be operated having a much longer duty cycle, i.e., a much greater time between neutron pulses without pre-ignition. The neutron source 30 is substantially identical to that of the circuit of FIG. 2 except for having a resistor 31 shunted between the annular anode 32 and the annular cathode 33. As with the other neutron sources, the source 30 includes a corona point 34 (which is a sharp pointed electrode) and which is preferably fixed to the inside surface of the source. Since the space between the tip of the corona point 34 and the cathode 33 is narrower than the space between the cathode and any other grounded point of the source, all leakage flow between the cathode and ground (except for the beam current) will be concentrated between the corona point 34 and the nearest surface of the cathode 33.

Since the resistor 32 provides a direct current path between anode 32 and cathode 33, corona current is established without the necessity for the ion source to conduct. The value of the resistor 31 is determined by the firing voltage of the ion source and the current available from the Van de Graaf generator and is selected so that the potential across the ion source due to the corona current through the resistor 31 is below the firing voltage of the ion source. For example, while the value of the resistance 31 might be in the range of 35 megohms, the resistance of the insulator 38 might well be five orders of magnitude higher, for example, several thousand megohms or even several million megohms. As with the other embodiments, the cathode 33 and the center electrode or anode 37 pass through an insulator 39. Then, with all control elements adjusted for normal source operation but with the pulser 35 disabled, all current from the Van de Graaf flows through the resistor 31 as corona current. If the firing voltage of the ion source is 900 volts and the Van de Graaf generator produces 20 microamps of current, 700 volts will be developed across a 35 megohm resistor and the ion source will not conduct. Since the ion source cannot produce ionization current, there are no neutrons produced by the source. However, when a high voltage pulse of appropriate amplitude from the pulser 35 is applied to the annular pulsing electrode 36, the voltage of the anode 32 and center wire anode 37, with respect to the cathode 33 increases until the ion source conducts and a burst of neutrons is produced. The resistor and the conduction of the ion source cause the voltage across the ion source to decrease rapidly and the ion source to extinguish. The system capacitances are again charged by the Van de Graaf and the next high voltage pulse causes the cycle to repeat. It should be appreciated that the system can remain energized for an almost indefinite period of time before a high voltage pulse is applied to cause a burst of neutrons to result. In this embodiment, the source emits neutrons only when high voltage pulses are supplied to the pulsing electrode 36 which is in contrast to the prior art embodiments of FIGS. 1 and 2 wherein the source emits neutrons in a continuous mode in the absence of high voltage pulses applied to the pulsing electrode and wherein the source even pre-ignites in the pulsed mode if the time spacing between high voltage pulses is too large.

With the source according to FIG. 3, the width of the neutron burst is determined by the combined effects of the high voltage pulse shape and amplitude, Van de Graaf charging current and the value of the shunt resistor 31. The source 30 of FIG. 3 may be pulsed at a frequency as low as desired to as high as perhaps 10,000 cycles per second. It should also be appreciated that the pulsing frequency can be modulated at some lower frequency to provide a cycle appropriate for almost any measurement that one might wish to make.

Figure 4:
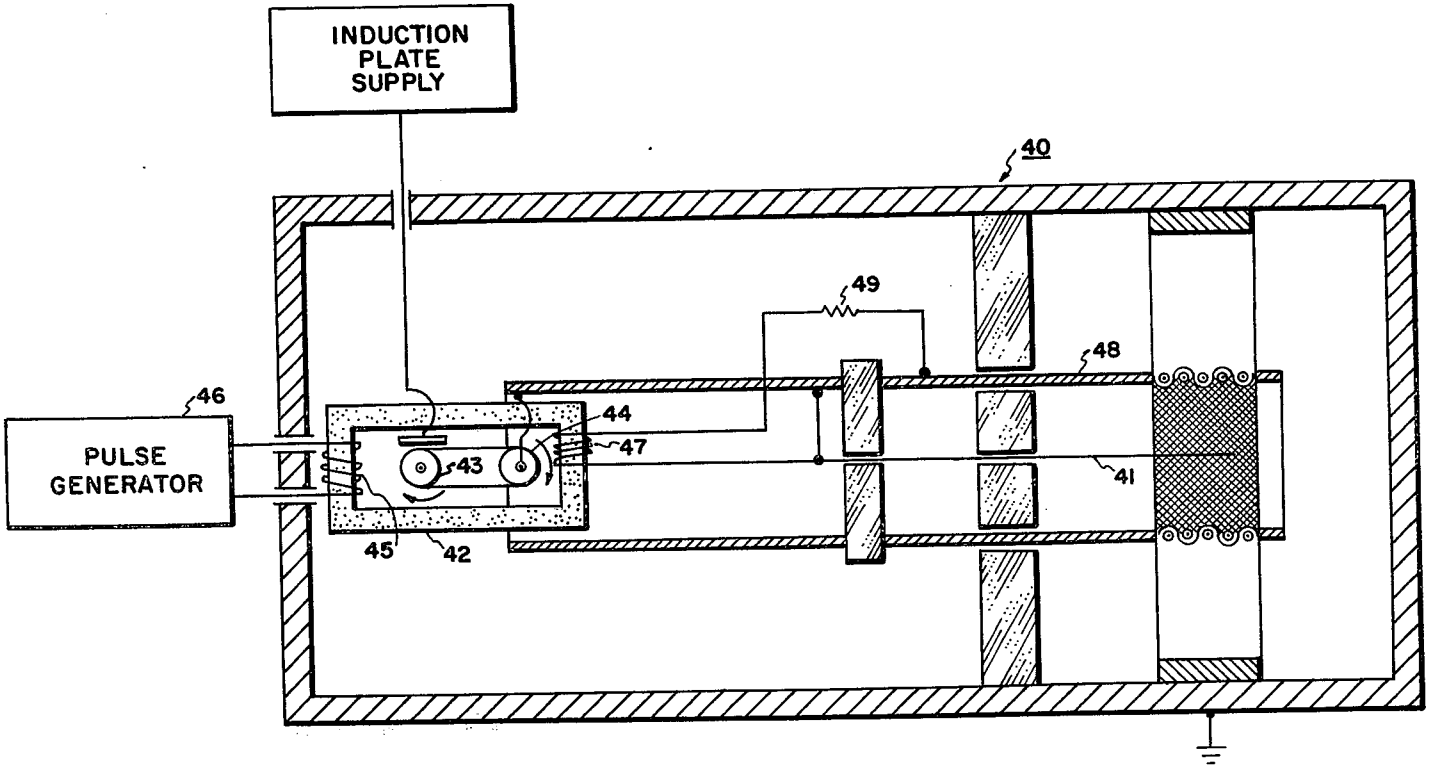
FIG. 4 is a schematic diagram of an alternative embodiment of a pulsed neutron source in accordance with the present invention.

Referring now to FIG. 4, there is illustrated an alternative embodiment of the present invention wherein the pulsed neutron source 40, illustrated diagrammatically, is fabricated substantially identical to the prior art sources of FIGS. 1 and 2 except for the following differences. A positive trigger pulse is coupled into the center wire anode 41 by means of transformer coupling. This transformer coupling may be effected by means of a core 42 which is preferably formed of a substance which may be magnetized but which is substantially non-conductive, though under favorable circumstances, adequate coupling may be effected without a magnetic core. The core 42, which may form the support column for the upper and lower pulleys 43 and 44 of the Van de Graaf generator, also supports a primary winding 45 of the transformer which is connected to receive trigger pulses from any suitable pulse generator 46 and a secondary winding 47 which is connected between the anode 41 and the cathode 48. A current limiting resistor 49 is connected in series with the secondary coil 47.

In the operation of the source of FIG. 4, it should be appreciated that the shunt resistance of the secondary coil 47 and resistor 49 function much like the resistor 31 in FIG. 3 which allows the source 40 to remain off until pulses are generated by the pulse generator 46.

Figure 5:
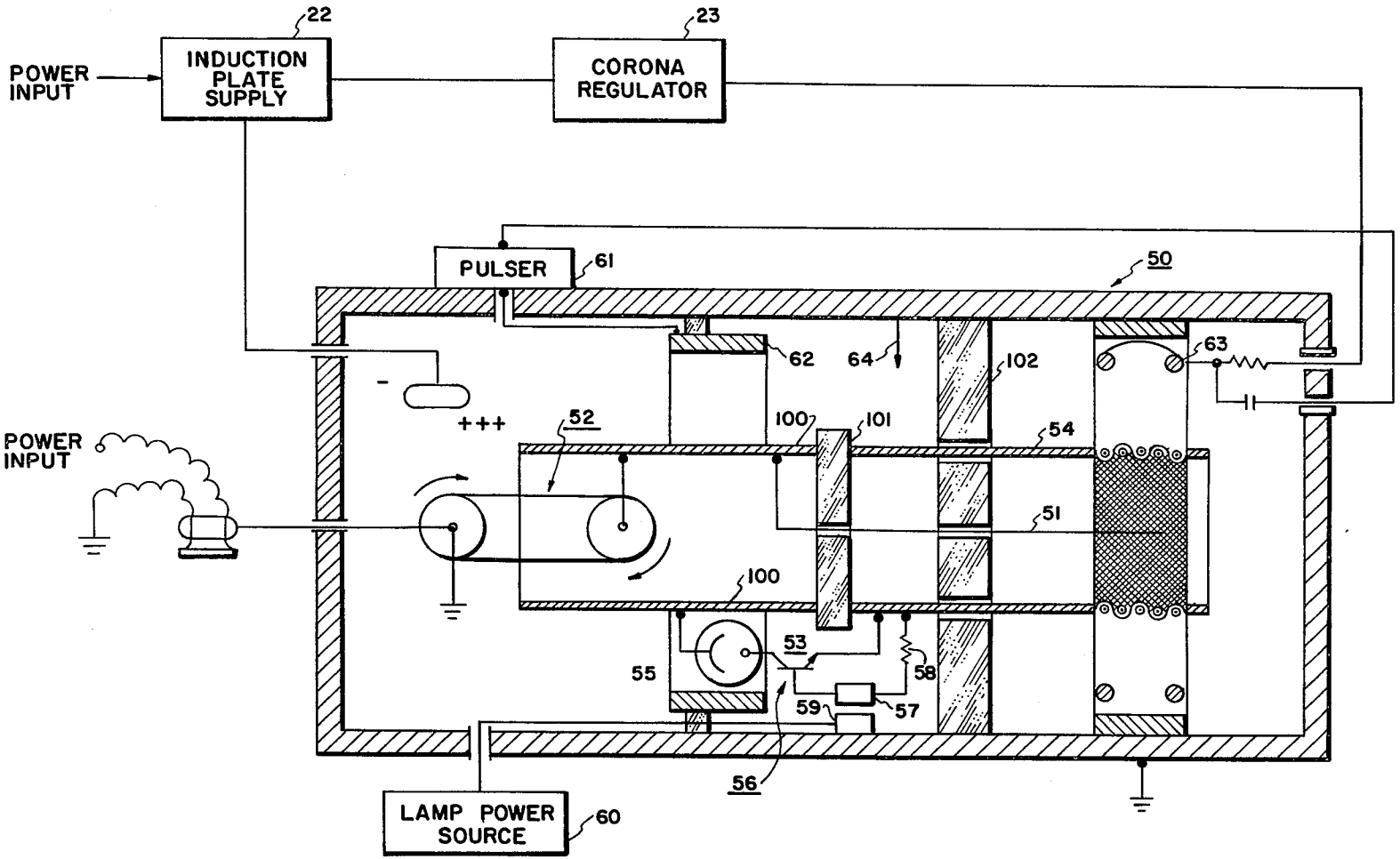
FIG. 5 is a schematic diagram of an alternative embodiment of a pulsed neutron source in accordance with the present invention.

Referring now to FIG. 5, there is illustrated an alternative embodiment of the present invention wherein a neutron source 50 is fabricated essentially like the prior art sources of FIGS. 1 and 2 except for the following differences. The center wire anode 51 and the annular anode 100 are connected to a high voltage side of the Van de Graaf generator 52. A shunt circuit 53 provides a means of shunting the anode 51 to the annular cathode 54. The anode 100 and the annular cathode 54 are separated by a high resistance insulator 101, constructed, for example, like the insulator 38 of FIG. 3. The shunt circuit 53 includes a corona regulator 55, for example, one of the Victoreen GV 1 series of appropriate value in series with the collector-emitter of transistor 56 wherein one side of the corona regulator 55 is tied to the anode 51 of the source 50 and the emitter of transistor 56 is tied to the cathode 54 of the source 50. The base of transistor 56 is tied to one or more small area silicon solar cells 57, for example, the Centralab 58C, which in turn are connected through a current limiting resistor 58 to the cathode 54. The corona regulator 55 is selected to have a regulating voltage about 50 to 100 volts below the firing voltage of the ion source. A light source 59 with a focusing lens is situated within the tank opposite the solar cells 57. The light source 59 is powered from an appropriate lamp power source 60 which may be external to the tank. A pulsing source 61 for pulsing the source 50 may or may not be included as desired. If used, the pulser 61 is connected to the pulsing electrode 62 and also to the suppressor rings 63 as desired, all as shown in the prior art configurations of FIGS. 1 and 2.

In the operation of the source of FIG. 5, if the light source 59 is extinguished, there is no base current for the transistor 56 generated by the solar cells 57 and the source will operate substantially as shown in my aforementioned U.S. Pat. No. 3,787,686. If the light source 59 is activated, transistor 56 is caused to conduct by the base current generated by the solar cells 57 and the Van de Graaf current flows through the corona regulator tube 55 and the transistor in the form of corona current caused by the corona point 64. Thus, the ion source will be disabled and no neutrons will be produced. Then, when the light source is again extinguished, the source will operate as though there were no shunt. With a fast responding light source, the ion source is caused to generate short bursts of ions which produce correspondingly short bursts of neutrons. However, in conjunction with the pulser 61, the source may be operated in the normal manner when short bursts of neutrons at a periodic rate are required and the shunt transistor 56 operated when longer on-off periods are desired. Additionally, the two can be operated in conjunction, i.e., the pulser 61 used in conjunction with the lamp power source 60, to produce intervals where no neutrons are produced interspersed with intervals where short neutron bursts are produced at a cyclic rate. It should be appreciated that the corona regulator tube 55 is included with the transistor to prevent the ion source capacitance from being completely discharged; thus, the peak current through the transistor is reduced and ion source voltage will reach the firing point more rapidly than if the capacitance were completely discharged. This also allows a lower voltage transistor to be used.

It should thus be appreciated that the neutron sources built in accordance with the various embodiments of the present invention produce vastly more flexible capability. As an example of the measurements that can be made, the reactions $^{24}Mg(n,p)^{24}Na$, $^{27}Al(n,a)^{24}Na$ and $^{23}Na(n,\gamma)^{24}Na$ produce a 470 key gamma ray with a 20 millisecond half life. The reaction cross sections for these reactions are 48, 33 and 400 millibarns, respectively. The cross section-abundance product for magnesium is sufficient to allow the measurement to be valuable in lithology identification of formation rock.

Figure 6:
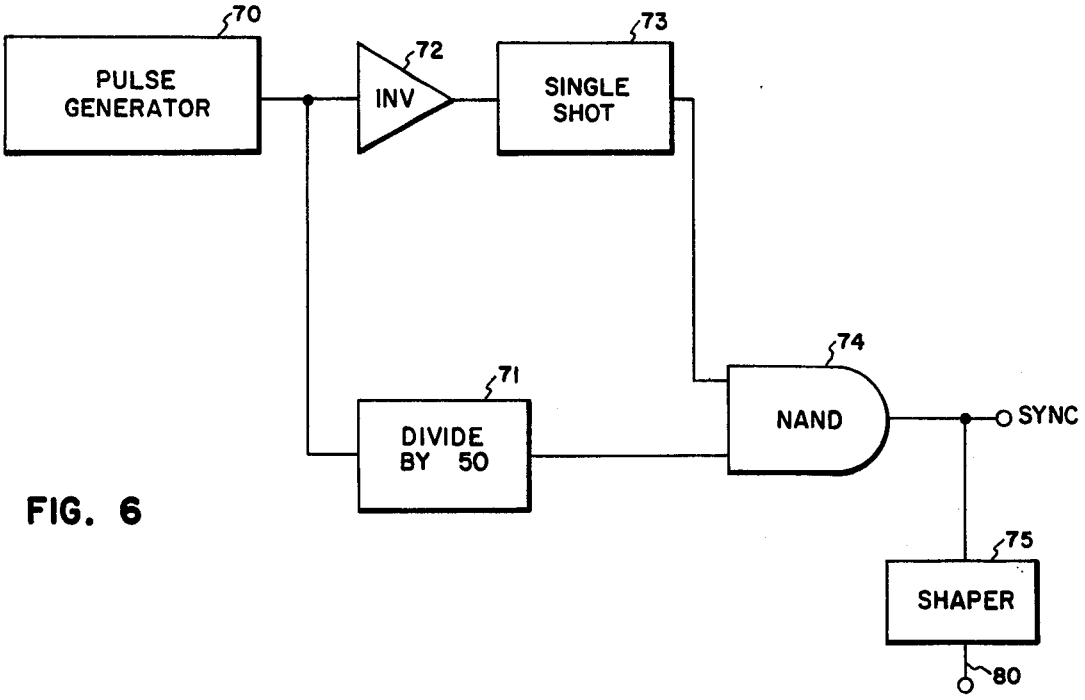
FIG. 6 is a block diagram of an electronic circuit in accordance with the present invention which utilizes one of the pulsed neutron sources in accordance with the present invention.
Figure 7:
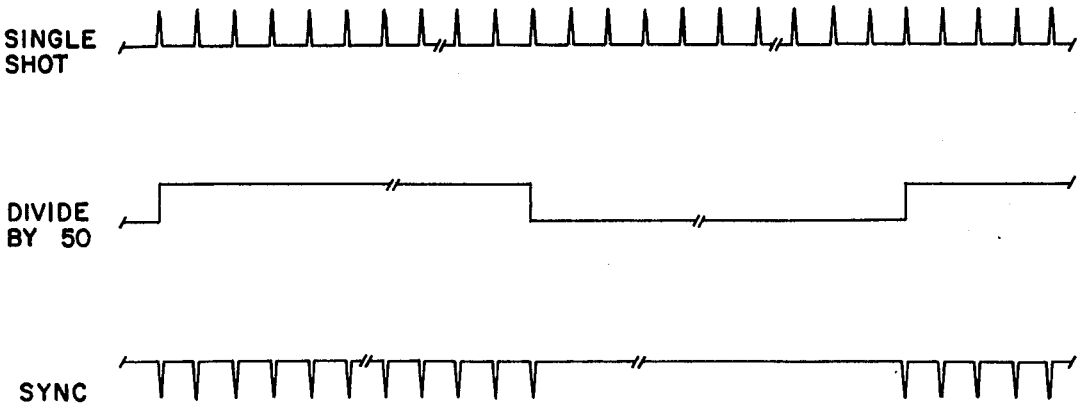
FIG. 7 is a timing diagram illustrating various waveforms found witin the circuitry of FIG. 6 in accordance with the invention.

Referring now to FIG. 6, a circuit is provided for pulsing the source in accordance with the various embodiments of the present invention. A pulse generator 70 is set to produce a 10 microsecond wide negative pulse at the rate of 1000 such pulses per second and which are fed into a divide-by-50 circuit 71 and also to an inverter 72 which drives the sync width single shot circuit 73. The outputs of the divide-by-50 circuit 71 and the single shot circuit 73 are coupled into the input of a NAND gate 74. The divide-by-50 circuit 71 is set to trigger on the leading edge of the generator pulse from the generator 70 and the single shot circuit 73 triggers on the trailing edge of the inverted generator pulse. Thus, the leading edge of the single shot output is delayed by about 10 microseconds with respect to the leading edge of the divide-by-50 output. These two outputs are fed to the NAND gate 74 which produces 25 full-width sync pulses one millisecond apart followed by a 25 millisecond interval in which there are no sync pulses. FIG. 7 provides a timing diagram of this circuit. The sync pulses so produced drive the high voltage pulser, for example, the pulser 35 of FIG. 3, which causes the neutron source to produce 25 neutron bursts one millisecond apart followed by a 25 millisecond interval during which no neutrons are produced. The sync pulse is also shaped by the shaper circuit 75 and fed to a conventional line amplifier (not shown) for transmission to the surface electronics along conductor 80 along with the output pulses from the radiation detector (not shown) in the wall logging instrument.

Figure 8:
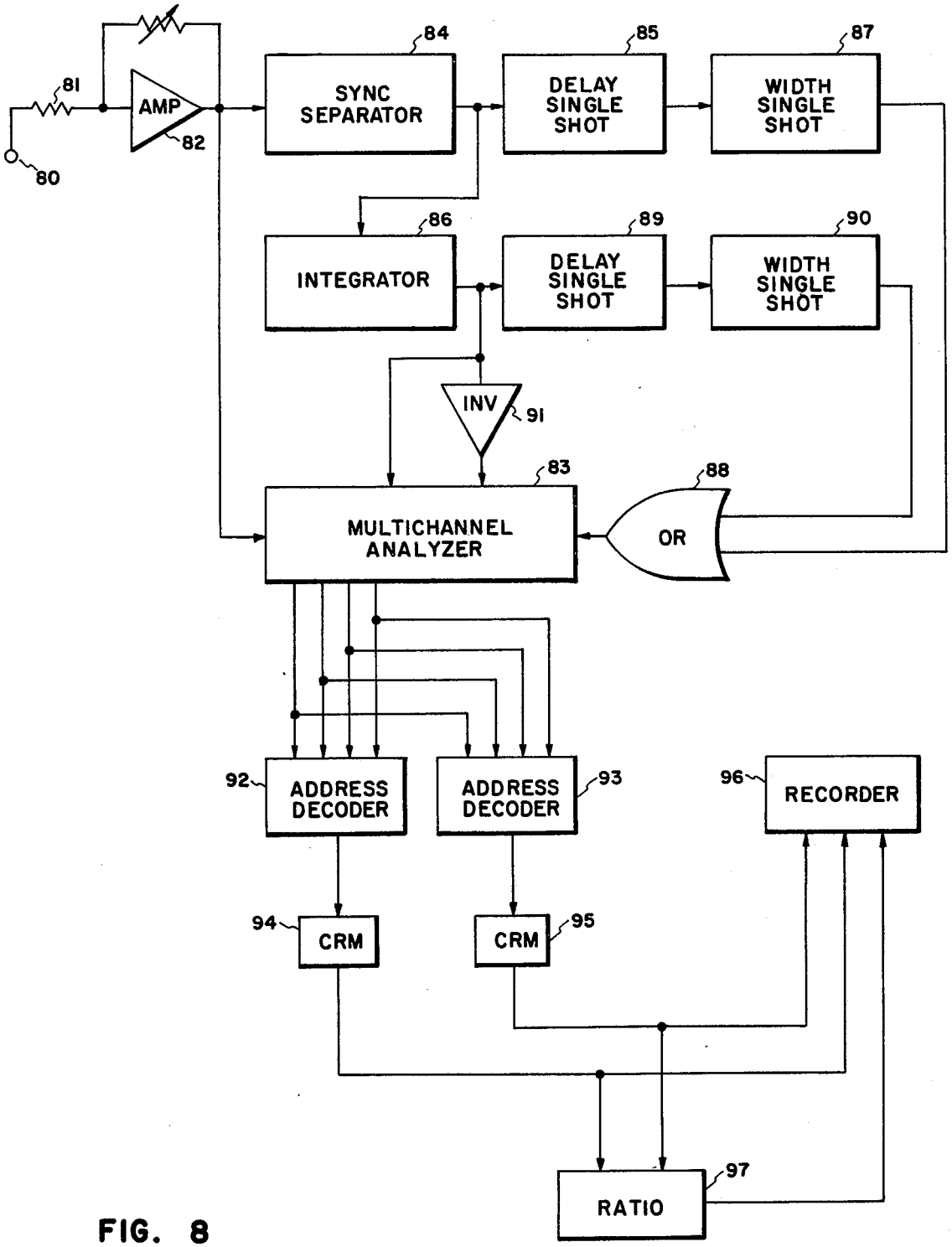
FIG. 8 is a block diagram of circuitry in accordance with the present invention which utilized at the earth's surface as a part of a well logging operation.

Referring now to FIG. 8, there is illustrated in block diagram a surface electronics system which separates the sync pulses from the amplified radioactivity detector pulses and which delivers them to a single shot circuit and integrator circuit. The well logging conductor cable 80 is connected through resistor 81 to an operational amplifier 82, the output of which is connected to a multichannel analyzer 83 and also into a sync separator circuit 84. The output of the sync separator circit 84 is connected to a delay single shot circuit 85 and also into an integrator circuit 86. The output of the delay single shot circuit 85 is connected to the input of a width single shot circuit 87 having an output which is connected into one of the two inputs of an OR gate 88. The output of the integrator circuit 86 is connected into a delay single shot circuit 89 having an output which is connected to the input of a width single shot circuit 90, which in turn has an output which drives the other input to the OR gate 88. The output of the OR gate 88 is also connected to the multichannel analyzer 83.

The output of the integrator 86 is also coupled into the multichannel analyzer 83 as in the inverted output of the integrator 86 through the inverter circuit 91.

The outputs of the multichannel analyzer 83 are connected into a pair of address decoders 92 and 93 which can be constructed in accordance with my copending U.S. patent application Ser. No. 244,013, for "ADDRESS DECODER FOR USE WITH MULTICHANNEL ANALYZERS", filed Apr. 12, 1972, now abandoned. The outputs of the address decoders 92 and 93 are connected, respectively, to the counting rate meters 94 and 95. The outputs of the counting rate meters 94 and 95 are connected to the inputs of a recorder 96. The outputs of the counting rate meters 94 and 95 are also connected into a ratio circuit 97 whose output is also recorded by the recorder 96.

In the operation of the circuitry of FIG. 8, considered in conjunction with the timing diagram of FIG. 7, it should be appreciated that the integrator circuit 86 integrates the 25 pulses of each cycle to produce an approximately symmetrical 20 cycle per second square wave. The integrator output controls one-half of the memory storage of the multichannel analyzer and the inverted integrator output controls the other half. The integrator output drives a gate delay single shot circuit 89 which in turn drives a gate width single shot circuit 90. The width output of the circuit 90 is fed into one input of the OR gate 88 which drives the coincidence input of the multichannel analyzer 83. The sync separator circuit 84 drives a similar pair of single shot circuits which provide a second input of the OR gate 88. The single shot circuits associated with a sync separator are adjusted, for example, to furnish a pulse that is 600 microseconds wide and which begins 350 microseconds after each sync pulse. The single shot circuits associated with the integrator are adjusted to produce a pulse that is 24.9 milliseconds wide and which begins one millisecond after the last sync pulse of each cycle.

Thus, the multichannel analyzer 83 is made to sequentially store in alternate halves of the memory those pulses produced by thermal neutron capture in the time interval 350 to 950 microseconds after each sync pulse and those pulses produced by neutron activation which occur in the time interval one millisecond to 25.9 milliseconds after the last sync pulse in each cycle. The two address decoders, fabricated in accordance with my aforementioned co-pending U.S. patent application, decode the address output and drive the count rate meters 94 and 95 which in turn drive a recorder. The ratio of the count rate meter output is also derived and recorded. If one decoder, for example, is set to pass pulses corresponding to gamma rays produced by thermal neutron capture by calcium, and the second is set to pass pulses corresponding to gamma rays produced by the 20 millisecond magnesium activation, a ratio responsive to the dolomitization of limestone may be recorded.

Thus it should be appreciated that there have been illustrated and described herein the preferred embodiments of a new and improved pulsed neutron source finding special utility in the logging of earth boreholes. Furthermore, circuitry has been provided for utilizing the outputs of detected radiation emanating from the earth formations as a result of irradiating such formations with the sources in accordance with the present invention. The well logging instrument, including the radioactivity detectors, has not been illustrated since any conventional radioactivity logging instrument can be utilized, for example, as is illustrated and described with respect to FIG. 1 of my aforementioned U.S. Pat. No. 3,787,686 which is incorporated herein by reference. Although only the preferred embodiments of the present invention are illustrated and described herein, obvious modifications to these embodiments will occur to those skilled in the art. For example, while the use of a resistor is contemplated as the means of providing a shunt between the cathode and anode of the pulsed neutron source, other or additional impedance means may be used. Furthermore, while the insulator between the annular anode and annular cathode of each embodiment is technically a very high resistor, the resistance is much too high to function as a shunt circuit for the corona current. It should also be appreciated by those in the art that detection circuitry such as is described in U.S. Pat. Nos. 3,379,882 and 3,379,884 can also be used in the borehole instrument to measure the rate of the decline of the thermal neutron population following the short burst of neutrons described herein, in addition to the other measurements relating to either the derivation of an indication of inelastic scatter gamma rays or those measurements relating to activation logging.

The embodiments of the invention in which an exclusive property or privilege is claimed are defined as follows:

1. A pulsed neutron source, comprising:

an ion beam accelerator having an anode and a cathode and direct current shunting circuitry between said anode and said cathode for shunting the accelerating gap voltage stabilizing corona current therebetween, said accelerator also having a static atmosphere substantially composed of a heavy isotope of hydrogen, means to ionize said atmosphere and a target containing a heavy isotope of hydrogen arranged to receive atmosphere ions; and pulsing means interconnected with said ionization means to periodically ionize said atmosphere.

2. The pulsed neutron source according to claim 1 wherein said shunting circuitry comprises a resistor.

3. The pulsed neutron source according to claim 1 wherein said shunting circuitry comprises an inductor.

4. The pulsed neutron source according to claim 3 wherein said shunting circuitry also comprises a resistor.

5. The pulsed neutron source according to claim 1 wherein said shunting circuitry comprises a transistor.

6. The pulsed neutron source according to claim 5 wherein said shunting circuitry also comprises a corona regulator in series with said transistor.

7. The pulsed neutron source according to claim 6, including in addition thereto, means for providing base current to said transistor as a function of a light source.

8. A pulsed neutron source, comprising:

an ion beam accelerator having an anode and a cathode and direct current shunting circuitry between said anode and said cathode for shunting the accelerating gap voltage stabilizing corona current therebetween, said accelerator also having a static atmosphere substantially composed of a heavy isotope of hydrogen, means to ionize said atmosphere and a target containing a heavy isotope of hydrogen arranged to receive atmosphere ions; and means to vary the effective impedance of said shunting circuitry.

9. The pulsed neutron source according to claim 8 wherein said shunting circuitry comprises a transistor.

10. The pulsed neutron source according to claim 9 wherein said shunting circuitry also comprises a corona regulator in series with said transistor.

11. The pulsed neutron source according to claim 10, including in addition thereto, means for providing base current to said transistor as a function of a light source.

12. The pulsed neutron source according to claim 8, including in addition thereto, pulsing means interconnected with said ionization means to periodically ionize said atmosphere.

13. A pulsed neutron source, comprising:

an ion beam accelerator having an anode and a cathode and direct current shunting circuitry between said anode and said cathode for shunting the accelerating gap voltage stabilizing corona current therebetween, said accelerator also having a static atmosphere substantially composed of a heavy isotope of hydrogen, means to ionize said atmosphere and a target containing a heavy isotope of hydrogen arranged to receive atmosphere ions; and pulsing means interconnected with said ionization means to periodically ionize said atmosphere, said pulsing means comprising:

a pulse source; and a transformer having a primary coil connected to said pulse source and a secondary coil forming at least a portion of said shunting circuitry.

14. The pulsed neutron source according to claim 13 wherein said shunting circuitry also comprises a resistor in series with said secondary coil.

* * * * *